US005784955A

United States Patent [19]

Conrad

[11] Patent Number: 5,784,955

[45] Date of Patent: Jul. 28, 1998

[54] CALENDER IN A PAPER-MAKING OR A COATING MACHINE

[75] Inventor: Hans-Rolf Conrad, Dormagen, Germany

[73] Assignee: Voith Sulzer Finishing GmbH, Krefeld, Germany

[21] Appl. No.: 746,663

[22] Filed: Nov. 14, 1996

[30] Foreign Application Priority Data

Nov. 21, 1995 [DE] Germany ..... 295 18 424 U

[51] Int. Cl.[6] ..... D21G 1/00

[52] U.S. Cl. ..... 100/329; 100/162 R; 100/167; 100/172; 100/173; 100/331; 100/334

[58] Field of Search ..... 100/161–167, 100/172–174, 331, 334, 103, 329

[56] References Cited

U.S. PATENT DOCUMENTS

| | | | |
|---|---|---|---|
| 454,322 | 6/1891 | Bacon | 100/166 |
| 2,300,994 | 11/1942 | Thiele et al. | 100/163 A |
| 3,044,392 | 7/1962 | Minarik | 100/162 R |
| 3,451,331 | 6/1969 | Fredrickson et al. | 100/162 R |
| 3,756,912 | 9/1973 | Rooney | 100/173 |
| 4,022,366 | 5/1977 | Rooney . | |
| 4,332,191 | 6/1982 | Kankaanpaa | 100/162 R |

FOREIGN PATENT DOCUMENTS

| | | | |
|---|---|---|---|
| 39 24 897 | 2/1991 | Germany . | |
| 36-4901 | 3/1961 | Japan . | |
| 56-159393 | 12/1981 | Japan . | |
| 2-300396 | 12/1990 | Japan . | |
| 4-185790 | 7/1992 | Japan . | |
| 5-500089 | 1/1993 | Japan . | |
| 969912 | 9/1964 | United Kingdom | 100/173 |
| 91/03600 | 3/1991 | WIPO . | |

*Primary Examiner*—Stephen F. Gerrity
*Attorney, Agent, or Firm*—Darby & Darby

[57] ABSTRACT

A calender has at least four rollers that are located one above the other. The rollers rotate about roller bearings. The calender is located within a paper-making machine. Each of the rollers is rotatably driven by an independent driving mechanism. At least two of the rollers are heatable. At least 40% of the rollers are soft rollers. The outer coverings of the soft rollers are made of a synthetic material that is not sensitive to marking so that a doctor blade can be applied to the soft rollers. The calender includes a device that inserts a paper guide strip into the calender.

12 Claims, 1 Drawing Sheet

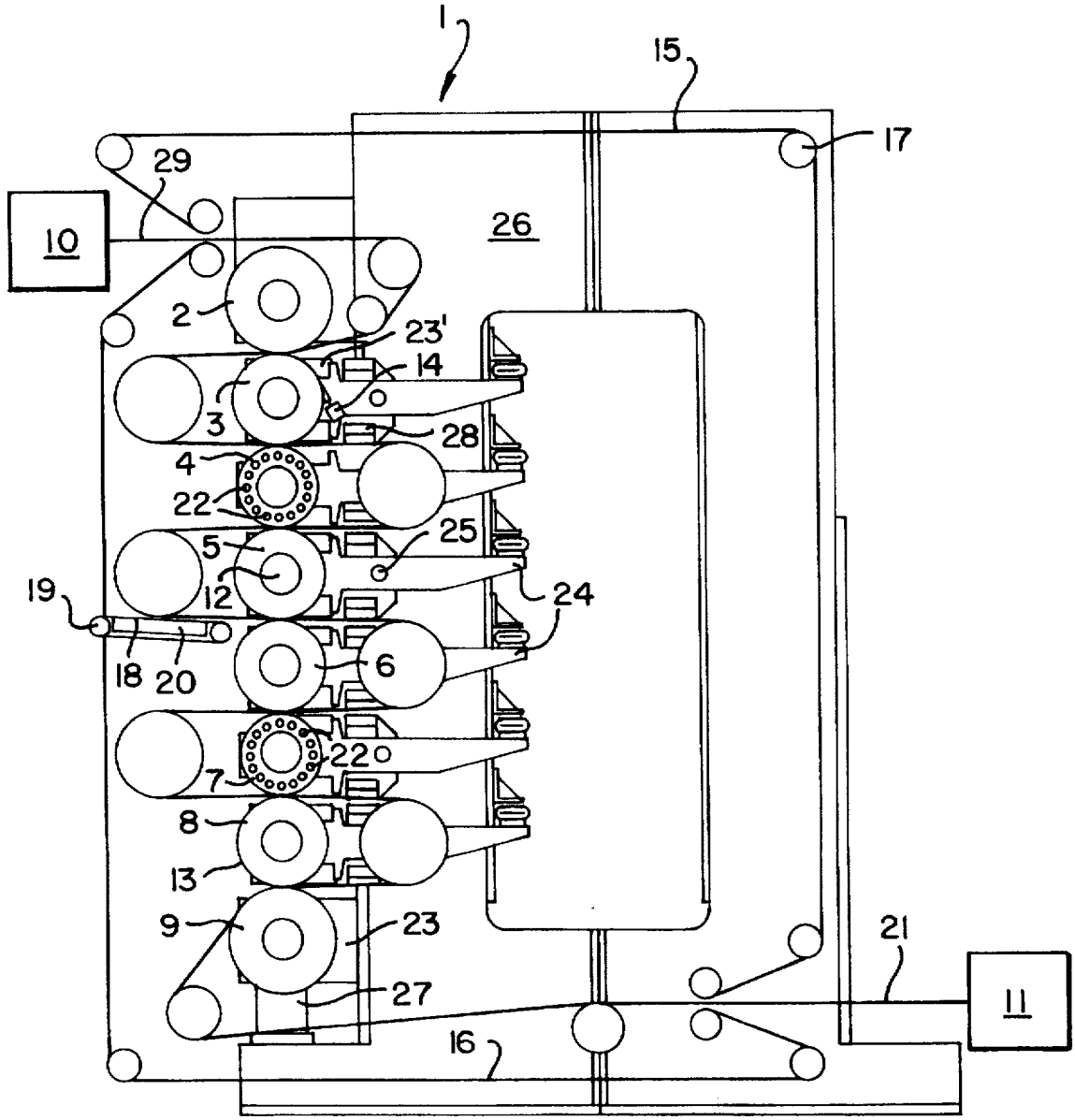
1
15
17
29
10
26
2
23'
14
3
28
4
22
25
5
12
24
19
18
20
6
22
7
8
13
9
23
21
27
11
16

CALENDER IN A PAPER-MAKING OR A COATING MACHINE

BACKGROUND OF THE INVENTION

1. Field of the Invention

The present invention relates to a calender for processing a paper web, which is arranged in-line within a paper-making or coating machine.

2. Discussion of the Related Art

Soft calenders are well-known to those skilled in the art of manufacturing paper. Soft calenders are made of hard and soft rollers. The hard rollers are heatable and are typically made form cast iron or steel. The soft rollers form one or two roller gaps with the hard rollers. The calender can be located within a paper-making or a coating machine. However, soft calenders can only be used for paper that is relatively easy to glaze, such as paper that is used for newspapers. The paper that is generated in the paper-making machine is glazed before it is rolled up for the first time.

Super-calenders are used for glazing higher quality paper, such as photogravure paper. However, super-calenders are located outside of the paper-making machine and include a larger stack of rollers (as compared to soft calenders) that are arranged one above the other. This type of calender, which also has hard, heated rollers and soft rollers, is connected in series with a roll unwinding device. An unglazed paper web is wound up on a roll after exiting from the paper-making machine. Thereafter, the unglazed paper is unwound from the roll and is fed through eight (8) to thirteen (13) roller gaps in the super-calender. Afterwards, the paper web is wound up again on a roll. At least 40% of the rollers in a super-calender are soft rollers. Because a super-calender has many more roller gaps than a soft calender, greater deformation work can be applied to the paper web, which, for example, provides high gloss and smoothness properties to the paper web.

Those skilled in the art have recognized the need to dispose a super-calender in a paper making machine. But, to date, every attempt has failed, primarily for the following reasons:

1. In super-calenders, after the paper web has passed through a roller gap, the web is fed back over an idler roller to the next roller gap. This reversing of the paper web by almost 180° could not be realized until now, with the conventional idler roller radius of approximately 150 to 200 mm and the high introduction speeds of approximately 1000 to 1200 m/min because of the high centrifugal forces that the paper web experiences as it passes over the idler rollers;

2. Closing an individual roller gap, when the paper web is travelling at high speeds, was not possible without tearing the paper web. (In super-calenders, the roller gaps are conventionally closed after manual introduction of the paper web when travelling at very low speeds or when the web is stationary);

3. The low service life of the super-calender's soft rollers (approximately one week) did not permit frictionless and continual operation of the paper-making machine. Servicing the soft rollers was required because the rollers, for the most part, were covered with fiber material. The soft rollers had to be dismantled from the super-calender and the markings caused by folds in the paper had to be ground away.

4. Access to the soft rollers of a super-calender in a paper-making machine is not possible. Access to the soft rollers is required to clean resin and coating deposits off of the soft rollers, which maintenance is required for the life of the outer covering of the soft rollers. The removal of deposits from a soft roller such as, for example, with a doctor blade, is also not possible because this process destroyed the outer covering; and 5. A super-calender, which runs at approximately the same high speed as the paper-making machine, inadequately supplies heat to the paper web, particularly in the case of very high quality paper (such as, for example, coated art stock). Thus, oil heating, which has a relatively great heat transfer to the heating rollers, would have to be used in inline operations to supply the required amount of heat to achieve the desired smoothness value in the paper web. However, oil heating is too costly for most applications. Thus, it was necessary to connect, in an off-line manner, two or possibly even three super-calenders to the paper-making machine.

Additionally, to integrate glazing into the paper-making machine, several soft calenders, placed in series, must be used, which requires a considerable amount of floor space.

SUMMARY OF THE INVENTION

Accordingly, it is an object of the present invention to provide a calender that is suitable for producing high quality paper for operation within a paper-making or coating machine.

This object is achieved in accordance with a preferred embodiment of the present invention with a calender that is disposed in a paper-making machine. The calender is disposed in one of a paper-making and a coating machine. The calender includes at least four rollers that are disposed one above the other. Each of the rollers is rotatably mounted on bearings. Each of the rollers is independently rotatably driven. At least two of the rollers are heatable. At least 40% of the rollers are soft rollers. The soft rollers have an outer covering that is made of a synthetic material, which is insensitive to marking so that a doctor blade can be applied to the soft roller. A device is mounted proximate to the calender so that a paper guide strip can be inserted into the calender.

One or two roller gaps, which are present in a soft calender, is not sufficient to glaze higher quality paper. At least four roller gaps are required within a paper-making or coating machine to achieve satisfactory glazing. Thus, at least five rollers must be disposed one above the other. Therefore, at least the center roller bearings (i.e., those roller bearings disposed between the uppermost roller bearing and the lower most roller bearing) should be connected, via levers, to the calender frame. The paper web is introduced into the calender when the roller gaps are open. The roller gaps are opened by a conventional separation device, the use of which is known in super-calenders. The roller gaps are typically opened by lowering the lowermost roller with the use of a hydraulic cylinder, thereby causing the levers corresponding to the center rollers to impact against a lower limit stop. The position of the lower limit stops is adjustable so that the roller gaps are opened by a distance of 5 to 10 mm. To close the roller gaps after the paper web has been introduced, the hydraulic cylinder is used to lift the lowermost roller thereby causing the center rollers' levers to lift off of the lower limit stops, thereby causing the lowermost and center rollers to lift up until all of the roller gaps are closed.

Each of the rollers is rotatably driven by its own driving mechanism. The individual driving mechanisms ensure that the circumferential speed of the respective roller matches the web speed. Thus, the paper web is not torn when the roller gaps are closed.

The heatable rollers are designed so that good heat transmission occurs from a heating medium to the paper web because uniform heating of the paper web is essential for the glazing process. Water vapor (i.e., steam), which is available in sufficient quantities in most paper factories, provides better and more uniform heat transmission over the entire width of the roller. The steam is preferably applied from a heat transfer medium to the inside wall of the roller by convection. Alternatively, the heating rollers can also be provided with peripheral bores, through which the steam is directed. Preferably, at least two of the rollers are heatable to achieve adequate glazing results with high quality paper.

The soft rollers have an outer covering that is preferably made of a synthetic material. The outer covering is resistant to abrasion so that it will have an adequate service life. Otherwise, the entire paper manufacturing process would have to be interrupted to change the soft rollers. Additionally, the outer covering is highly resistant to marking, since any damage to the soft roller coverings is immediately noticeable in the paper. Finally, the covering is conditioned so that it is not destroyed when engaged with a doctor blade for cleaning the rollers. Only a synthetic covering is suitable for achieving these three requirements.

An additional device is required to guide the paper web through the calender. This additional device assists in inserting a guide strip (i.e., a longitudinally extending portion of the paper web) into the calender because the paper web must be fed, after passing through a roller gap around an idler roller to the next roller gap. But, in contrast with a supercalender, this initial feeding of the paper web occurs at relatively high speeds (e.g., the speed of a paper-making machine).

The device for inserting a guide strip could be, for example, two accompanying cables that are disposed parallel to one another through the desired paper course (i.e., path) in the calender. A guide strip, which is cut from the paper web, is clamped between the parallel cables, and is therefore, guided through the calender. The two cables are brought together in front of the entry into the calender. Thus, at the entry of the calender, the two cables form a so-called "cable shears", as for example shown in DE 3g248g7A1 the disclosure of which is hereby incorporated by reference. Thus, only the guide strip is guided into the calender. The two cables are fed together over cable rollers through the desired path through the calender. The cables open up once again after exiting the calender to release the paper guide strip.

The guide strip, which can have a width of 300 to 500 mm, is cut in front of the entry to the calender from the web exiting from the upstream portion of the paper-making machine. While the guide strip is then fed through the calender to (for example, a take-up spool), the majority of the paper web (i.e., the non-guide strip portion of the paper web) is guided into a pulper. Once the insertion process of the guide strip has been completed, the guide strip is cut even wider by moving a cutting device accordingly until the complete width of the paper web is ultimately fed through the calender.

In addition to or as an alternative to cables, insertion devices can be used. The guide strip is guided onto an endless perforated carrying belt that moves at a speed that approximates that of the paper-making or coating machine. A suction box is disposed below the carrying belt to cause the paper web to adhere to the carrying belt and be carried along with the carrying belt. Such an insertion device is for example shown in U.S. Pat. No. 4,022,366, the disclosure of which is hereby incorporated by reference.

Air jets or air deflectors of known designs can also be used as additional guides.

BRIEF DESCRIPTION OF THE DRAWING

The above and still further objects, features and advantages of the present invention will become apparent upon consideration of the following detailed description of a specific embodiment thereof, especially when taken in conjunction with the accompanying drawing, and wherein:

The sole drawing FIGURE schematically illustrates a calender disposed within a paper-making or coating machine.

DETAILED DESCRIPTION OF THE PREFERRED EMBODIMENT

Referring now to the sole drawing FIGURE, a calender 1 is illustrated. Calender 1 includes eight rollers 2, 3, 4, 5, 6, 7, 8, 9. Four of the rollers 2, 4, 7, 9 have a hard metallic outer surface and four of the rollers 3, 5, 6, 8 have an soft synthetic outer covering 13. Each of the rollers 2–9 are independently driven by its own driving mechanism 12.

All of the rollers 2–9 are rotatably mounted on bearings in respective bearing housings 23, 23'. Each bearing housing 23' for the center rollers 3, 4, 5, 6, 7, 8 is attached to a lever 24. The fulcrum 25 of each lever 24 is pivotably mounted on the calender frame 26. A hydraulic cylinder 27 is preferably disposed below the lowermost roller 9. Hydraulic cylinder 27 applies the necessary force for glazing in the closed roller gaps. Additionally, hydraulic cylinder 27 selectively lowers the lowermost roller 9 to open the roller gaps. When the lowermost roller 9 is lowered beyond a predetermined position, the levers 24 are supported on lower limit stops 28 and adjacent rollers a re spaced from each other by about 5 to 10 mm in the roller gaps. When the rollers are spaced apart it is possible to insert a portion of the paper web, known as a guide strip 21, into the calender. The sole drawing FIGURE shows the configuration of the calender after the rollers have been closed once again, by reversing the movement (i.e., lifting) the hydraulic cylinder 27.

In a preferred embodiment, steam is fed, in a conventional manner, to the two center hard rollers 4, 7 for heating purposes. The steam is guided through peripheral bores 22 in rollers 4, 7 so that heat from the steam is released to the respective roller.

The preceding part 10 of the paper-making machine is disposed in front of (i.e., upstream from) the calender 1 and the following part 11 of the paper-making machine is disposed after (i.e., downstream from) the calender 1. The preceding part 10 and the following part 11 are illustrated schematically as boxes. The following part 11 of the paper-making machine can be, for example, a take-up spool.

As illustrated, a commercially available doctor blade 14 is disposed selectively in contact with an outer circumferential surface of soft roller 3. In practice, a doctor blade 14 is preferably installed proximate to a majority of the soft rollers 3, 5, 6, 8.

A device is preferably used to insert the paper web into the calender. In one embodiment, the device includes two continuous accompanying cables 15, 16 that are fed over cable rollers 17 so that they form cable shears 29 in front of the calender. A guide strip 21 (i.e., a longitudinally extending portion of the paper web), which is exiting from the preceding part of 10 the paper-making machine, is clamped between cables 15, 16. Cables 15, 16 feed guide strip 21 through the calender and release the guide strip 21 after it exits the calender 1 for entry into the subsequent part 11 of the paper-making machine. This initial feeding of the paper web occurs at relatively high speeds (e.g., the speed of a paper-making machine).

The two accompanying cables 15, 16 are disposed parallel to one another through the desired paper course (i.e., path) in the calender. A guide strip 21, which is cut from the paper web, is clamped between the parallel cables 15, 16. The two cables 15, 16 are brought together in front of the entry into the calender. Thus, at the entry of the calender, the two cables form a so-called "cable shears" 29, which catch the longitudinally extending guide strip 21 of the paper web. Thus, only the guide strip 21 is guided into the calender by cables 15, 16. The two cables 15, 16 are fed together over cable rollers through the desired path through the calender. The cables open up once again after exiting the calender to release the paper guide strip.

Guide strip 21, which can have a width of 300 to 500 mm, is cut upstream of the entry to the calender from the web exiting from the upstream portion 10 of the paper-making machine. While guide strip 21 is then fed through the calender to, for example, a take-up spool, the majority of the paper web (i.e., the non-guide strip portion of the paper web) is guided into a pulper. Once the insertion process of the guide strip has been completed, the guide strip is cut even wider by moving a cutting device accordingly until the complete width of the paper web is ultimately fed through the calender.

A carrying belt 18 is disposed adjacent to the inlet of the juncture of soft rollers 5, 6. Carrying belt 18 is perforated and is an endless belt that rotates around two support rollers 19. One of the support rollers 19 is positively driven in a conventional manner (not shown). A suction box 20 is disposed under the portion of carrying belt 18 that carries guide strip 21. A partial vacuum is generated in suction box 20 in a conventional manner (not shown). Suction box 20 is open in the direction of the carrying belt 18 so that the guide strip 21 can be drawn toward the suction box 20, due to the perforations in the carrying belt 18, so that guide strip 21 adheres to carrying belt 18.

Having described the presently preferred exemplary embodiment of a calender in a paper-making or a coating machine in accordance with the present invention, it is believed that other modifications, variations and changes will be suggested to those skilled in the art in view of the teachings set forth herein. It is, therefore, to be understood that all such modifications, variations, and changes are believed to fall within the scope of the present invention as defined by the appended claims.

What is claimed is:

1. A calender being disposed in one of a paper-making and a coating machine, said calender comprising:

at least four rollers being disposed one above the other, each of said rollers being rotatably mounted on bearings, each of said rollers being independently rotatably driven, at least two of said rollers being heatable, at least 40% of said rollers being soft rollers, said soft rollers having an outer covering that is made of a synthetic material that is insensitive to marking so that a doctor blade can be applied to said soft roller; and means for inserting a paper guide strip into said calender, said inserting means including two cables between which said paper guide strip is clamped, said inserting means including a perforated carrying belt that moves at a speed that approximates that of the paper-making machine and, a suction box being disposed proximate to said perforated carrying belt.

2. The calender according to claim 1, wherein at least the rollers disposed between an uppermost roller and a lowermost roller are connected, via levers, to a calender frame.

3. The calender according to claim 2, wherein the heatable rollers are steam heated.

4. The calender according to claim 1, wherein the heatable rollers are steam heated.

5. A calender being disposed in one of a paper-making and a coating machine, said calender comprising:

at least four rollers being disposed one above the other, each of said rollers being rotatably mounted on bearings, each of said rollers being independently rotatably driven, at least two of said rollers being heatable, at least 40% of said rollers being soft rollers, said soft rollers having an outer covering that is made of a synthetic material that is insensitive to marking so that a doctor blade can be applied to said soft roller; and means for inserting a paper guide strip into said calender, said inserting means including a perforated carrying belt that moves at a speed that approximates that of the paper-making machine and, a suction box being disposed proximate to said perforated carrying belt.

6. The calender according to claim 5, wherein at least the rollers disposed between an uppermost roller and a lowermost roller are connected, via levers, to a calender frame.

7. The calender according to claim 6, wherein the heatable rollers are steam heated.

8. The calender according to claim 5, wherein the heatable rollers are steam heated.

9. A calender being disposed in one of a paper-making and a coating machine, said calender comprising:

at least four rollers being disposed one above the other, each of said rollers being rotatably mounted on bearings, each of said rollers being independently rotatably driven, at least two of said rollers being heatable, said at least two heatable rollers each having a plurality of peripheral bores for guiding a heating medium, at least 40% of said rollers being soft rollers, said soft rollers having an outer covering that is made of a synthetic material that is insensitive to marking so that a doctor blade can be applied to said soft roller; and means for inserting a paper guide strip into said calender.

10. The calender according to claim 9, wherein at least the rollers disposed between an uppermost roller and a lowermost roller are connected, via levers, to a calender frame.

11. The calender according to claims 10, wherein the heatable rollers are steam heated.

12. The calender according to claim 9, wherein the heatable rollers are steam heated.

* * * * *